US009452365B2

(12) United States Patent
Morgan

(10) Patent No.: US 9,452,365 B2
(45) Date of Patent: Sep. 27, 2016

(54) PORTABLE TREE SWING SYSTEM AND METHODS OF USE

(71) Applicant: Matthew Douglas Morgan, Jefferson, GA (US)

(72) Inventor: Matthew Douglas Morgan, Jefferson, GA (US)

( * ) Notice: Subject to any disclaimer, the term of this patent is extended or adjusted under 35 U.S.C. 154(b) by 4 days.

(21) Appl. No.: 14/290,332

(22) Filed: May 29, 2014

(65) Prior Publication Data

US 2014/0357388 A1 Dec. 4, 2014

Related U.S. Application Data

(60) Provisional application No. 61/828,602, filed on May 29, 2013.

(51) Int. Cl.
*A63G 9/00* (2006.01)

(52) U.S. Cl.
CPC ..... *A63G 9/00* (2013.01)

(58) Field of Classification Search
USPC ..... 472/118; 383/4
See application file for complete search history.

(56) References Cited

U.S. PATENT DOCUMENTS

| | | | | |
|---|---|---|---|---|
| 2,375,087 A | | 5/1945 | De Bruin | |
| 4,014,540 A | | 3/1977 | Caulkins | |
| 4,782,874 A | * | 11/1988 | Chartier | 150/112 |
| 5,427,575 A | * | 6/1995 | Berk | 472/118 |
| 5,704,669 A | * | 1/1998 | Clark | 294/209 |
| 5,765,487 A | * | 6/1998 | Neff | A47B 3/10 108/34 |
| 6,520,825 B1 | * | 2/2003 | Herr | 446/71 |
| 6,702,686 B1 | | 3/2004 | Brown | |
| 8,992,337 B1 | * | 3/2015 | Koziol et al. | 472/118 |
| D737,049 S | * | 8/2015 | Seip | D3/226 |
| 2002/0088059 A1 | * | 7/2002 | Reeves | 5/653 |
| 2005/0107173 A1 | * | 5/2005 | Pelletier | 472/118 |
| 2011/0241397 A1 | | 10/2011 | Spencer | |

OTHER PUBLICATIONS

Kevin Shay, UpSwing, http://www.shaykevin.com/upswing, captured May 18, 2012.*

Gorilla Playsets, Disc Swing, http://www.homedepot.com/p/Gorilla-Playsets-Disc-Swing-in-Green-04=8103/202409319, captured May 10, 2013.*

Playset Junction, Disc swing with rope, http://www.all4thekids.com/discswing.html, captured Feb. 25, 2009.*

"Tree Swing Plastic Disc" (http://www.swingset.com/product_p/r4-disk.htm).

"Tree Swing Wood Disc" (http://www.shopterrain.com/outdoor-living-decor/original-tree-swing/searchString/games).

"Rope Knot with Metal Ring" (http://penarthramblers.wordpress.com/walk-reports/january-2014/val-hs-birthday-walk around-a-very-wet-cardiff-bay-on-28-january-2014/).

* cited by examiner

*Primary Examiner* — Melba Bumgarner
*Assistant Examiner* — Laura L Davison
(74) *Attorney, Agent, or Firm* — Mathew L. Grell; Jeffrey C. Watson; Grell & Watson Patent Attorneys

(57) ABSTRACT

A planar seat having a center hole and a perimeter rim, a carrier bag affixed on one end to the perimeter rim of the planar seat and the other open end of the carrier bag having a closure mechanism to close the carrier bag, a support rope with a looped end and the other end with a stopper mechanism, and a retrieval line with a closeable fastener.

4 Claims, 6 Drawing Sheets

PORTABLE TREE SWING SYSTEM AND METHODS OF USE

CROSS REFERENCE TO RELATED APPLICATIONS

To the full extent permitted by law, the present United States Non-Provisional patent application claims priority to and the full benefit of United States Provisional patent application entitled "GoSwing, a portable rope swing system", filed on May 29, 2013, having assigned Ser. No. 61/828,602, incorporated entirely herein by reference.

TECHNICAL FIELD

The disclosure relates generally to a tree swing apparatus and more specifically it relates to a portable self-contained tree swing system.

BACKGROUND

The disclosure relates generally to a tree swing apparatus and more specifically it relates to a portable self-contained tree swing system. Various permanently installed or affixed swings, amusement devices and other pieces of playground equipment are known in the prior art, including pole supported swing sets and low-hanging tree limb supported swings or tire swings. Swings of this type are suspended by one or more linear support devices, such as rope or chain links permanently attached to an overhead support member. These support devices are typically constructed from zinc-plated or rubber coated steel chain, galvanized steel cable, ropes or straps made from natural or synthetic fibers and may include attachment hardware. Such swings and their support devices are difficult for a single person to transport or carry, especially if the overhead support member is some distance, such as a tree limb along a nature trail.

Therefore, it is readily apparent that there is a recognized unmet need for a portable tree swing system and methods of use, wherein such system integrates a special package, container or receptacle to house the linear support device, attachment hardware, and other supplies for easy transportation of the portable tree swing system.

BRIEF SUMMARY

Briefly described, in an example embodiment, the present apparatus and method overcomes the above-mentioned disadvantage, and meets the recognized need for a portable tree swing system and methods of use having, in general, a planar seat having a center hole and a perimeter rim, a carrier bag affixed on one end to the perimeter rim of the planar seat and the other open end of the carrier bag having a closure mechanism to close the carrier bag, a support rope with a looped end and the other end with a stopper mechanism, and a retrieval line with a closeable fastener, and, thus to enable easy transportation by one person of the portable tree swing system to the overhead support member, such as a tree limb and quickly assemble the portable tree swing system by installing and retrieving the support rope to an out-of-reach overhead object.

In an exemplary embodiment, portable tree swing apparatus for a tree limb, the apparatus having a planar seat, said planar seat having a hole positioned therein said planar seat and said planar seat having a seat perimeter edge, a sleeve, said sleeve having a first open end and a second open end, and said second open end having a sleeve perimeter edge, wherein said sleeve perimeter edge is affixed to said seat perimeter edge to close said second open end, a closeable mechanism, said closeable mechanism integrated with said first open end of said sleeve to releasably close said first open end.

Accordingly, a feature of the portable tree swing system and methods of use is its ability to enable easy transportation by one person of the portable tree swing system to the overhead support member, such as a tree limb.

Another feature of the portable tree swing system and methods is its ability to provide a container, such as carrier bag integrated with planar seat and configured to house or contain all necessary equipment for installation of a tree swing, such as support rope, stopper mechanism, retrieval line, closeable fastener and other miscellaneous items.

Yet another feature of the portable tree swing system and methods of use is its ability to provide a portable tree swing system designed for installation on an out-of-reach overhead object, such as a tree limb.

Yet another feature of the portable tree swing system and methods of use is its ability to provide a portable tree swing system transportable, installable, and retrievable by an individual.

Yet another feature of the portable tree swing system and methods of use is its ability to provide a portable tree swing that accommodates adults as well as children.

Yet another feature of the portable tree swing system and methods of use is its ability to be easily installed on medium to high tree branches and/or objects.

Yet another feature of the portable tree swing system and methods of use is its ability to provide all necessary equipment for installation of a tree swing, such as support rope, stopper mechanism, retrieval line, closeable fastener and other miscellaneous items in a functional integrated carrier.

Yet another feature of the portable tree swing system and methods of use is its ability to accommodate and be utilized on different height tree branches and/or objects.

Yet another feature of the portable tree swing system and methods of use is its ability to be installed and retrieved in a short duration of time (a few minutes).

Yet another feature of the portable tree swing system and methods of use is its ability to provide light weight alternative to swings made using chain, cable, and vertical reach poles.

Yet another feature of the portable tree swing system and methods of use is its ability to provide a swing that is easily operated by an unskilled ropes man.

Yet another feature of the portable tree swing system and methods of use is its ability to be less expensive and simpler to use than existing technology.

Yet another feature of the portable tree swing system and methods of use is its ability to enable a single person to setup and take down the swing without the help of another person.

Yet another feature of the portable tree swing system and methods of use is its ability to provide the primary compartment with a resealable opening integrated on one end to enable the user to remove and place the swing accessories, such as support rope, stopper mechanism, retrieval line, closeable fastener and other miscellaneous items therein the carrier bag.

Yet another feature of the portable tree swing system and methods of use is its ability to provide a closure mechanism to close the carrier bag that can be utilized to transport or carry the portable tree swing system by for example grasping the excess closure mechanism or slinging it over the shoulder.

Yet another feature of the portable tree swing system and methods of use is its ability to provide a compact tree swing system that can be stowed in the trunk of the car or carried in a backpack.

Yet another feature of the portable tree swing system and methods of use is its ability to be color customized, apply various branding, or otherwise personalized with a variety of color options for the planar seat, carrier bag, closure mechanism, support rope, stopper mechanism, retrieval line, and/or closeable fastener.

Yet another feature of the portable tree swing system and methods of use is its ability to be utilized to swing forward, backward, side-to-side, clockwise, counterclockwise, spin and the like.

These and other features of the portable tree swing system and methods of use will become more apparent to one skilled in the art from the following Detailed Description of the Embodiments and Claims when read in light of the accompanying drawing Figures.

BRIEF DESCRIPTION OF THE DRAWINGS

The present portable tree swing system and methods of use will be better understood by reading the Detailed Description of the embodiments with reference to the accompanying drawing figures, in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed invention.

DETAILED DESCRIPTION

In describing the exemplary embodiments of the present disclosure, as illustrated in FIGS. 1-5 specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Figure 1:
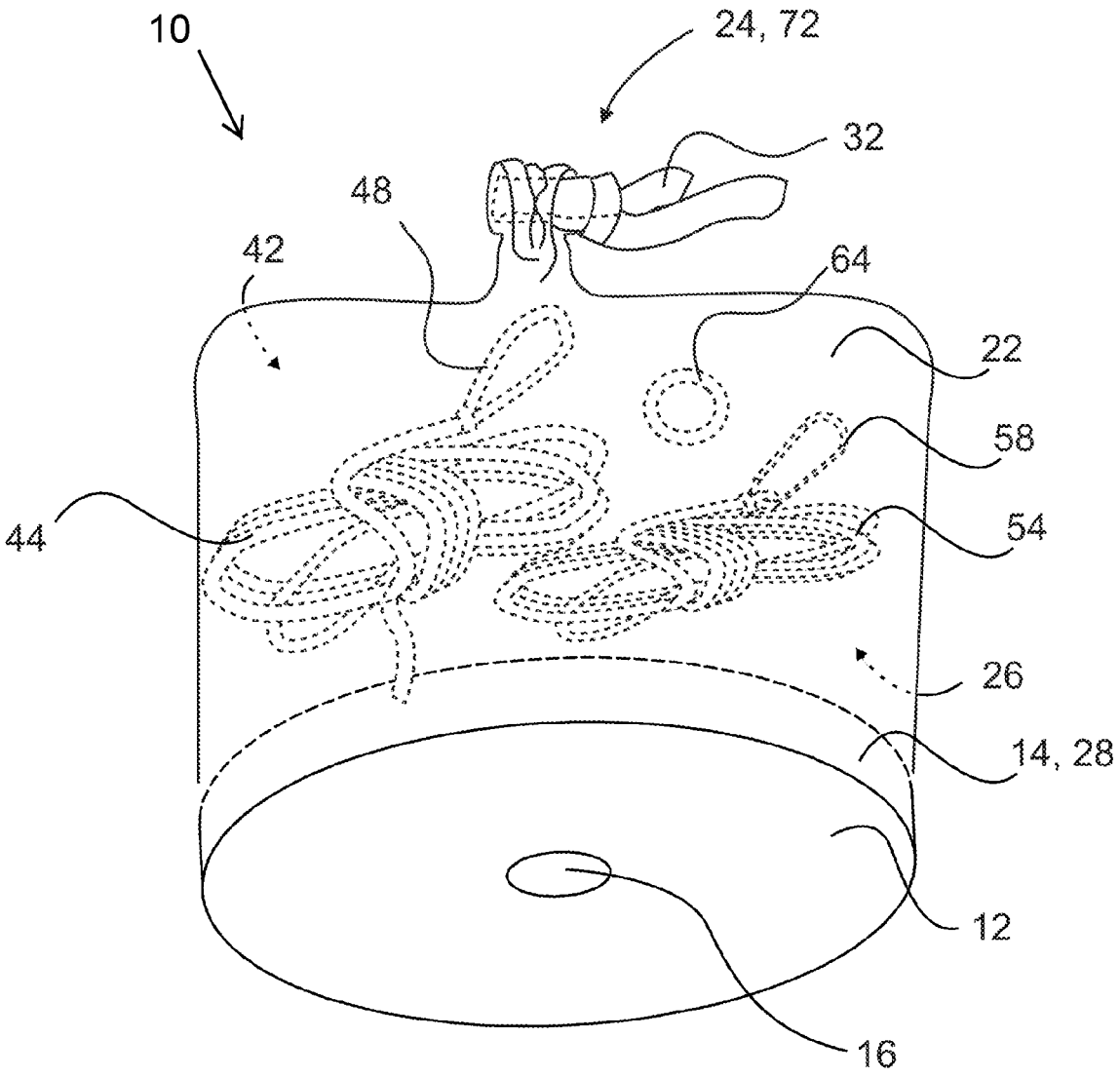
FIG. 1 is a perspective view of an example embodiment of the portable tree swing apparatus and system.
Figure 2:
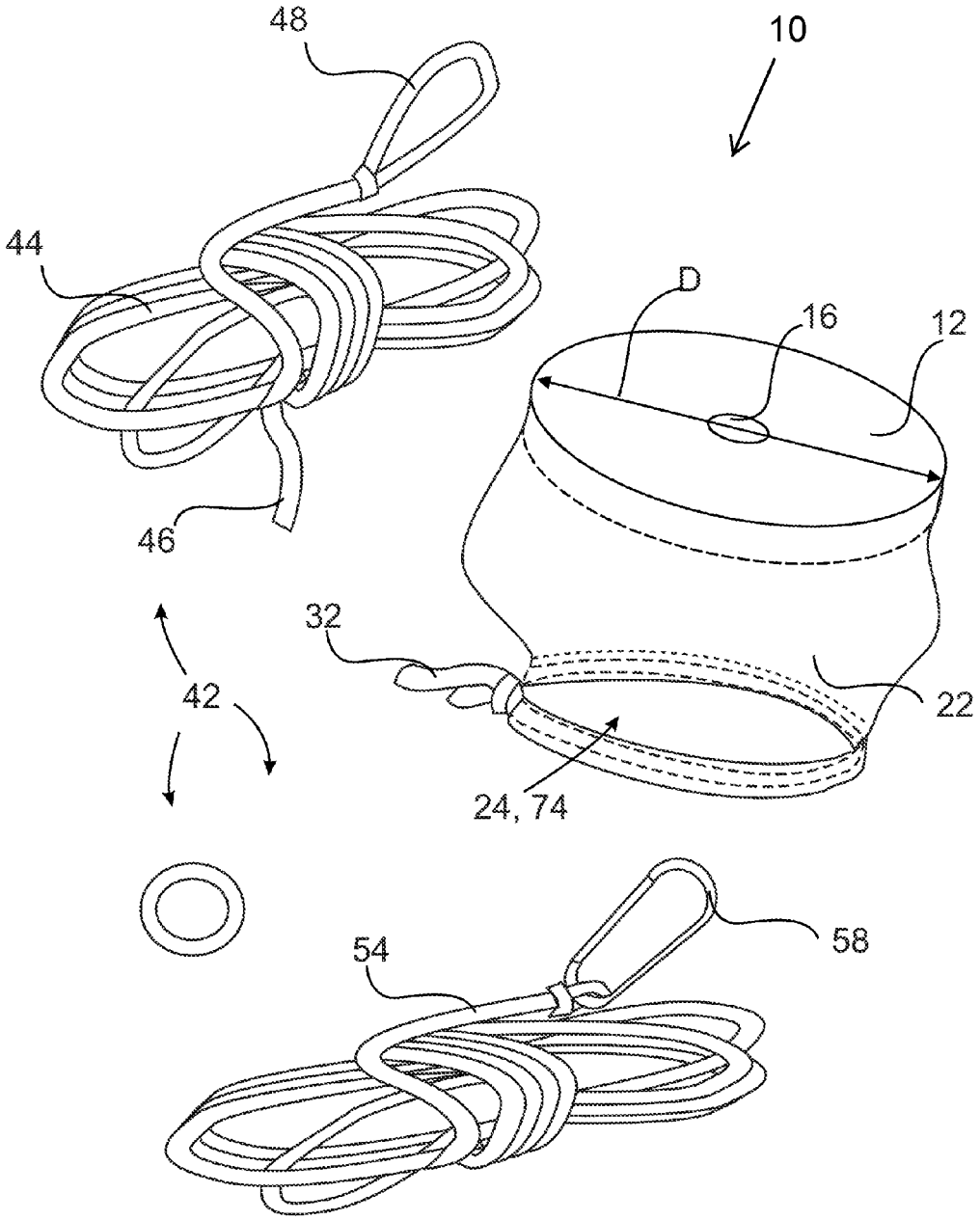
FIG. 2 is an exploded view of the portable tree swing apparatus and system of FIG. 1.

Referring now to FIGS. 1-2, by way of example, and not limitation, there is illustrated exemplary embodiment of a portable tree swing, such as portable tree swing system 10. As illustrated in FIG. 1, portable tree swing system (apparatus) 10 includes a platform, disc, seat or stool, such as planar seat 12 further having an aperture or hole positioned therein planar seat 12, such as hole 16 and planar seat 12 further includes an edge or rim, such as seat perimeter edge 14. Hole 16 may include a grommet or sleeve therein hole 16 to prevent rubbing therein hole 16. Furthermore, portable tree swing system 10 includes a carrier bag, containment or compartment bag, such as sleeve 22 having a first open end 24 and a second open end 26. Preferably, sleeve perimeter edge 28 of second open end 26 may be affixed to seat perimeter edge 14 of planar seat 12 to close or contain second open end 26 with planar seat 12. The other end of sleeve 22, first open end 24 may be closed or sealed or opened, such as by closeable mechanism 32. Closeable mechanism 32 is preferably configured proximate first open end 24 to provide open access and closed containment thereto sleeve 22 or first open end 24 of sleeve 22. Concealed or positioned therein closed sleeve 22, shown in closed position 72, may be portable tree swing accessories 42, items necessary to rig portable tree swing for use as a swing, such rigging may include support rope 44 configured with looped end 48 positioned at one end of support rope 44, retrieval line 54 with closeable fastener 58 positioned at one end of retrieval line 54, and stopper mechanism, such as ring 64.

It is recognized herein that closeable fastener 58 may be a knot, loop, clasp, other fastener, or the like.

It is contemplated herein that closable mechanism 32 may function as an integrated carrier for portable tree swing system 10.

It is further contemplated herein that carrier bag 22 integrated planar seat 12 is preferably configured to house or contain all necessary equipment for installation of a tree swing, such as support rope 44, ring 64, retrieval line 54, closeable fastener 58 and other miscellaneous items.

It is still further contemplated herein that support rope 44 is further dimensioned to pass therethrough hole 16.

It is still further contemplated herein that sleeve 22 may be configured as a carrier bag 22 having alternatively open end 24 and bottom 26. Planar seat 12 may be positioned therein carrier bag 22 and affixed to bottom 26 or bottom 26 may be mated up against the underside of planar seat 12 and affixed thereto.

As illustrated in FIG. 2, closeable mechanism 32 is shown in an open or unsealed position with first open end 24 of sleeve 22 configured in open position 74. Removed therefrom open sleeve 22, shown in open position 74, may be portable tree swing accessories 42, items necessary to rig portable tree swing for use as a swing, such rigging may include support rope 44 configured with a bowline knot, such as looped end 48 positioned at one end of support rope 44, retrieval line 54 with closeable fastener 58 positioned at one end of retrieval line 54, and stopper mechanism, such as ring 64. It is recognized herein that first open end 24 of sleeve 22 may include a re-sealable opening or slit, such as re-sealable open position 74 to enable insertion and/or retrieval of portable tree swing accessories 42 from sleeve 22. First open end 24 is preferably dimensioned to enable portable tree swing accessories 42 to be inserted therein or pass therein sleeve 22 or to enable portable tree swing accessories 42 to be removed therefrom sleeve 22. It is contemplated herein that re-sealable open position 74 may be configured anywhere thereon sleeve 22.

Planar seat 12 is preferably formed of a suitable material such as wood, metal, plastic, like polyethylene, Styrofoam, polymer, or composite material or the like, capable of providing structure to planar seat 12. Preferably, the material includes other suitable characteristics, such as durability, strength, water resistant, bend resistant, puncture resistant, tear resistant, light weight, chemical inertness, oxidation resistance, ease of workability, or other beneficial characteristic understood by one skilled in the art and as would meet the purpose described herein.

Planar seat 12 may have a diameter D between approximately 10 and approximately 15 inches; and most preferably approximately 12 inches and planar seat 12 may have a thickness between approximately ⅜ and 2 inches; and most preferably approximately 1.5 inches. It is contemplated herein that planar seat 12 may be disc or circular shaped, however, other shapes and dimensions may be utilized which meet the purpose described herein of a swing seat. Moreover, hole 16 may have a diameter between approximately ¼ and approximately 1.5 inches; and most preferably approximately ⅝ inch and hole 16 may positioned proximately centered therein planar seat 12 however, other dimensions of hole 16 and positioning of hole 16 are contemplated herein.

Sleeve 22 is preferably formed of a suitable material or woven fabric, such as cotton, silk, linen, rayon, acrylic, nylon, polyester, duck cloth, fabric with brushed twill lining, or vinyl, canvas, plastic, rubber, polyurethane, fiber, coated fiber or mesh, nylon, Tyvek, or the like, capable of providing collapsible structure to sleeve 22. Preferably, the material includes other suitable characteristics, such as durability, strength, water resistant, stretch resistant, puncture resistant, tear resistant, light weight, chemical inertness, oxidation resistance, ease of workability, or other beneficial characteristic understood by one skilled in the art and as would meet the purpose described herein.

Sleeve 22 may be configured from an approximately rectangular shaped material having sleeve perimeter edge 28, which is preferably configured with approximate length equal to a perimeter derived from diameter D of planar seat 12.

It is still further contemplated herein that sleeve perimeter edge 28 and seat perimeter edge 14 of planar seat 12 may be affixed, such as joined, bonded, glued or other adhesive, stapled, nailed, tacked, riveted, or otherwise affixed one to the other to close off or seal second open end 26 of sleeve 22.

It is further contemplated herein that sleeve 22 may be configured and/or sized to accommodate various sized portable tree swing accessories 42 and other miscellaneous items necessary for the purpose described herein.

Closeable mechanism 32 may be configured as a draw string, hook and loop, zipper, button, snap, eye holes and string or other openable and closeable device to enable placement therein, containment, and retrieval therefrom sleeve 22 of portable tree swing accessories 42 or other closure system understood by one skilled in the art and would meet the purpose described herein.

Figure 3A:
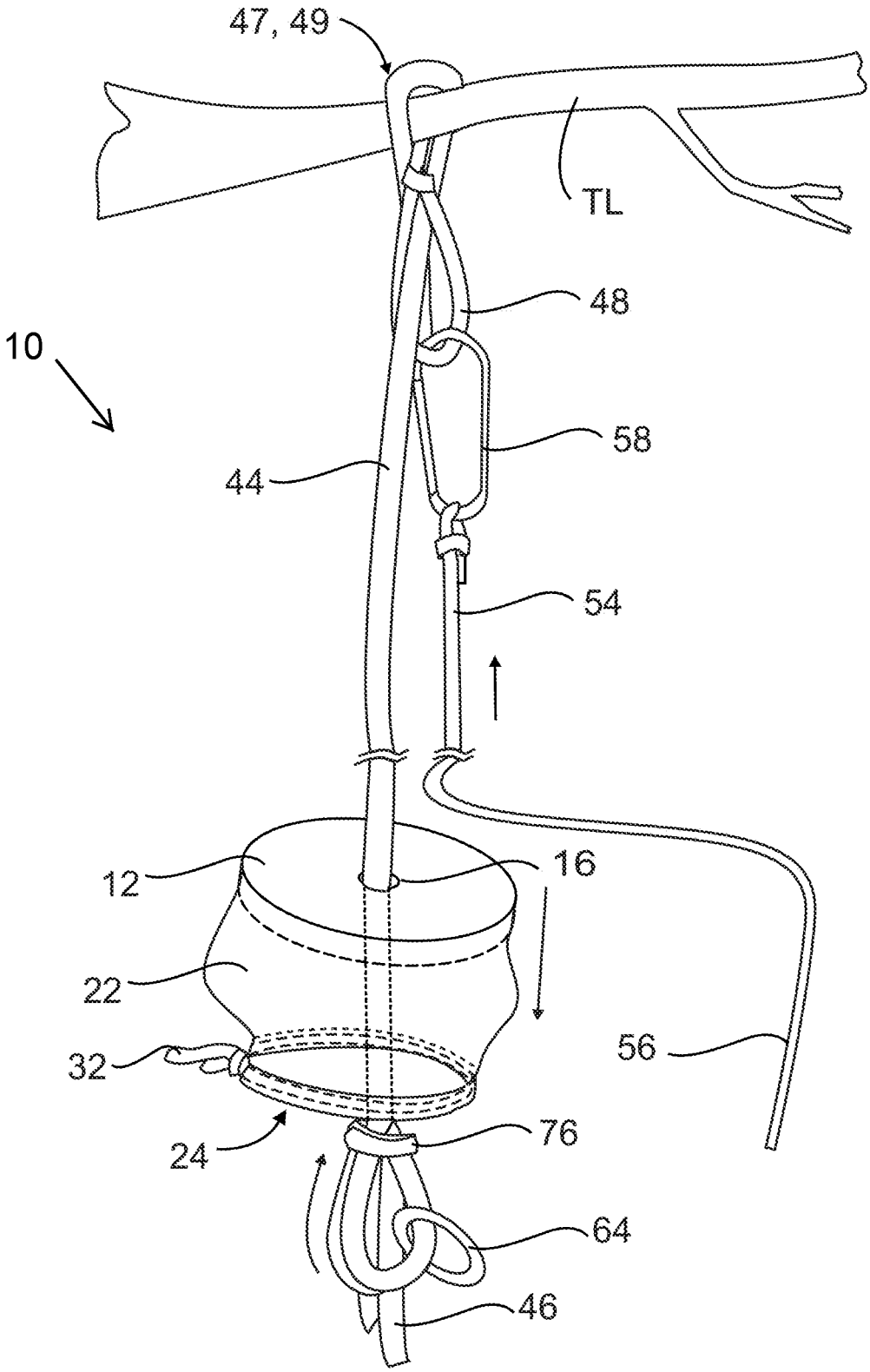
FIGS. 3A and 3B are use views of the portable tree swing apparatus and system of FIG. 1, shown affixed to a tree limb.

Referring now to FIGS. 3A/3B, by way of example, and not limitation, there is illustrated exemplary embodiment of portable tree swing system 10, shown in use. As illustrated in FIG. 3A/3B, looped end 48 positioned at one end of support rope 44 is flung, tossed, passed over, or thrown above and over overhead support member, such as tree limb TL until approximately the midsection of support rope 44, positioned between looped end 48 and free rope end 46 of support rope 44, is preferably positioned proximate tree limb TL. It is recognized herein that support rope 44 must be at least twice as long as tree limb TL is high to allow both ends to be within reach after it is thrown over tree limb TL.

It is contemplated herein that if necessary to reach a high tree limb TL, a weight, such as ring 64, may be attached to looped end 48 and the weight may be thrown over tree limb TL carrying looped end 48 to make looped end 48 rise higher when thrown and descend faster or easier back to the ground from tree limb TL. The weight is then detached from looped end 48 of support rope 44.

Next, the free end of support rope 44, such as free rope end 46 may be threaded through looped end 48 forming a very large running closed loop 47 around tree limb TL. Free rope end 46 may be pulled through looped end 48, which can be releasably tightened or cinched around tree limb TL, as shown in FIG. 3A/3B to form cinched rope 49 around tree limb TL.

It is recognized herein that the fastening method depends on the material selected for support rope 44. Steel chain is typically fastened around a branch using any of the variety of common replacement links (i.e. lap link or quick link or clip fasteners (i.e. safety spring link or carabineer). Steel cable is typically fastened around a tree branch by attaching it to itself with at least two cable clamps to make a loop end or running closed loop 47, such as looped end 48. Similarly, a running closed loop 47 can be formed with a steel cable (or chain) or the like by preferably making a small loop on one end of cable and securing it with cable clamps (bolt or fastener). The looped end of the cable (or chain) may be passed over the branch and the free end of the cable (or chain) may be threaded through the small loop to form running closed loop 47. Running closed loop 47 is as secure as any anchor but may be easily removed and leaves no permanent mark or indentation on the tree branch. Running closed loop 47 is self-tightening and allows no slipping and abrasion.

Next, closeable fastener 58 positioned at one end of retrieval line 54 may be affixed thereto looped end 48. Free rope end 46 may be pulled hoisting support rope 44 over tree limb TL and eventually tightening the running closed loop 47 around tree limb TL. Simultaneously, closeable fastener 58 and retrieval line 54 may be elevated to tree limb TL along with looped end 48.

Once support rope 44 is preferably releasably tightened or cinched around tree limb TL, the next step may be to affix or attach planar seat 12 thereto support rope 44. Planar seat 12 may be turned upside down where sleeve 22 is preferably pointing down, such as toward the underside of planar seat 12 or sleeve 22 may be turned inside-out and configured having sleeve 22 positioned on the underside of planar seat 12. Next, free rope end 46 of support rope 44, or free rope end 46 and free line end 56 of retrieval line 54 may be threaded through hole 16 of planar seat 12. Free rope end 46 and/or free line end 56 may be pulled through hole 16 of planar seat 12 and furthermore free rope end 46 and/or free line end 56 may be passed through sleeve 22 and out first open end 24 of sleeve 22. Next, planar seat 12 may be positioned vertically along support rope 44 and configured as a height adjustment of planar seat 12 relative to the ground to make a tree swing and enable a user to swing with their feet positioned on and off the ground.

It is contemplated herein that free rope end 46 of support rope 44 and/or free rope end 46 of support rope 44 and free line end 56 of retrieval line 54 may be threaded through hole 16 of planar seat 12. If free line end 56 of retrieval line 54 is not threaded through hole 16 of planar seat 12 it may be tied off or held out of the pathway of portable tree swing system 10 while portable tree swing system 10 is in use.

Figure 3B:
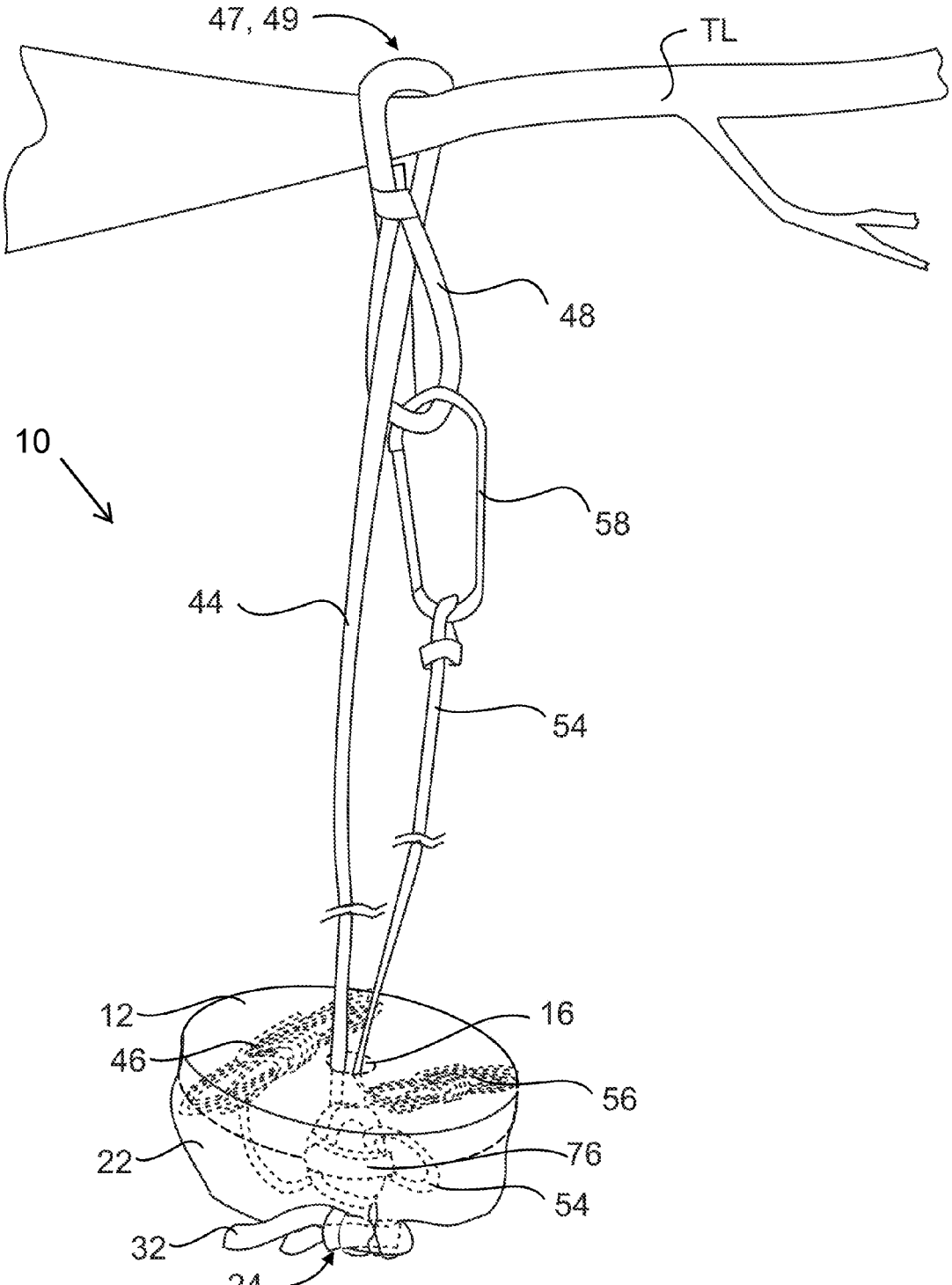

Next, free rope end 46 of support rope 44 may be tied off thereunder planar seat 12 utilizing a secure knot, such as knot 76 to support rope 44 on the underside of planar seat 12, which is preferably capable of supporting a user of portable tree swing system 10. Planar seat 12 preferably rests thereon knot 76 (as shown in FIG. 3B) to support a user of portable tree swing system 10. It is contemplated herein that stopper mechanism, such as ring 64 may be integrated into knot 76 to further secure knot 76, and thus, prevent knot 76 from coming untied during use of portable tree swing system 10 as a tree wing.

Moreover, knot 76 may be secured by first configuring a long skinny loop in support rope 44 by folding support rope 44; start to tie knot 76 with the long skinny loop, but before passing the long skinny loop though its self, slip ring 64 over the long skinny loop; pass the long skinny loop through itself keeping ring 64 from passing through; and tighten knot 76.

Next, gather up the remaining or unused lengths of rope from free rope end 46 of support rope 44 and free line end 56 of retrieval line 54 hanging below knot 76 under planar seat 12 and position or insert such rope therethrough first open end 24 of sleeve 22 positioned under planar seat 12. Next close or seal closeable mechanism 32 of sleeve 22 to contain or secure excess support rope 44 and retrieval line 54 therein sleeve 22 under planar seat 12 and preferably up off the ground or away from a user of portable tree swing system 10.

Next portable tree swing system 10 may now be used as a tree swing to swing forward, backward, side-to-side, clockwise, counterclockwise, spin and the like.

To disassemble portable tree swing system 10 reverse the above steps. Unseal or open closeable mechanism 32 and remove remaining or unused lengths of rope, such as free rope end 46 of support rope 44 and free line end 56 of retrieval line 54 from sleeve 22. Next, untie knot 76 on the underside of planar seat 12 and remove or slide ring 64 off free rope end 46 of support rope 44. Next, unthread free rope end 46 of support rope 44 back through hole 16 of planar seat 12 to remove planar seat 12 from support rope 44. Next, invert sleeve 22 configured with first open end 24 pointing upward or turn sleeve 22 outside-in configured having planar seat 12 positioned on the underside of sleeve 22.

Next, pull or tug on free line end 56 of retrieval line 54 to loosen running closed loop 47, such as support rope 44 threaded through looped end 48, cinched around tree limb TL and looped end 48 should descend with closeable fastener 58. Next, once closeable fastener 58 is preferably in hand unlatch closeable fastener 58 from looped end 48.

Next, unthread support rope 44 from looped end 48 reversing large running closed loop 47 around tree limb TL until free rope end 46 of support rope 44 is preferably fully removed from looped end 48. Next pull on free rope end 46 until looped end 48 of support rope 44 is preferably back up and over tree limb TL and returned to the ground.

Next, store support rope 44, closeable fastener 58, retrieval line 54, ring 64, therein sleeve 22 by insertion therein first open end 24 of sleeve 22. Next close or seal closure mechanism 32 of portable tree swing system 10.

It is contemplated herein that portable tree swing system 10 may be transportable, installable, and retrievable by an individual and such swing may accommodate adults as well as children.

Next portable tree swing system 10 may now be transported and/or stored until its next use.

Figure 4:
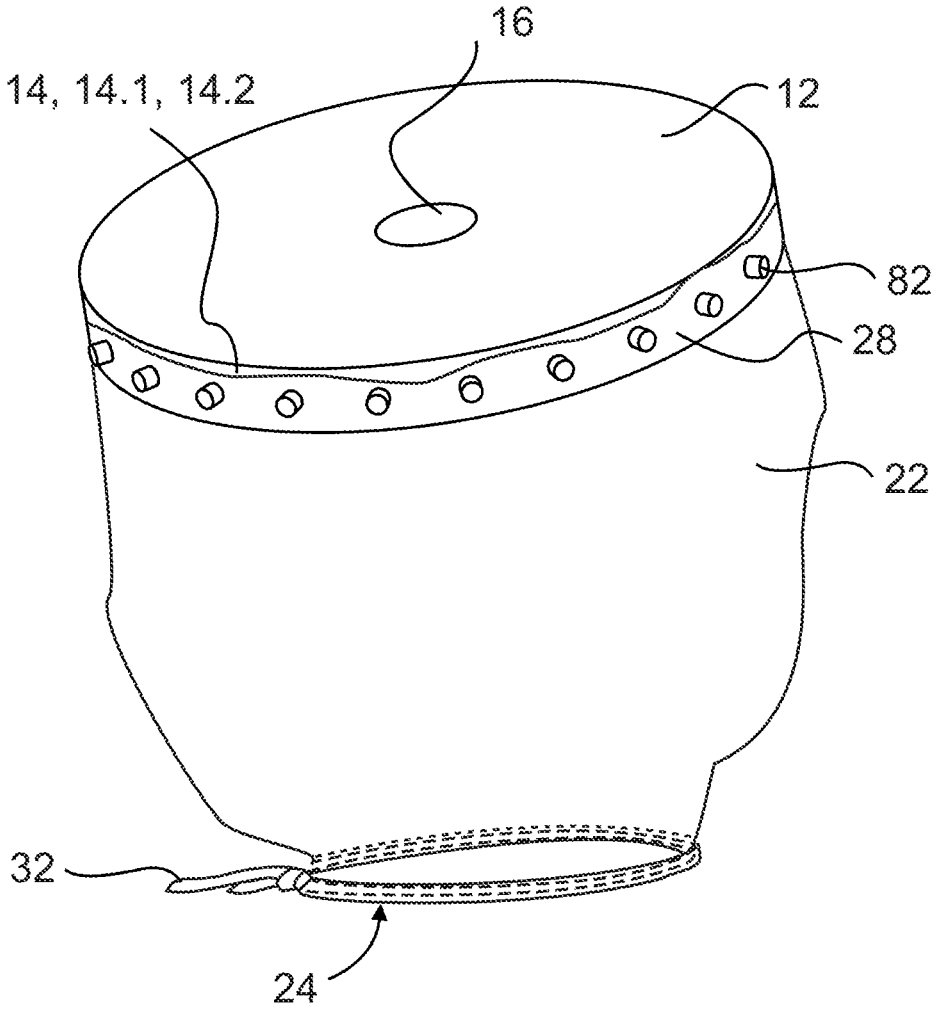
FIG. 4 is a perspective view of another example embodiment of the tree swing apparatus.

Referring now to FIG. 4, by way of example, and not limitation, there is illustrated another exemplary embodiment of portable tree swing system 10. Sleeve perimeter edge 28 of second open end 26 may be stapled, tacked or otherwise affixed to seat perimeter edge 14 of planar seat 12 to close or contain second open end 26 with planar seat 12. Furthermore, seat perimeter edge 14 may be configured as a rim and enable access to the backside of seat perimeter edge 14 wherein sleeve perimeter edge 28 of second open end 26 may be positioned proximate rim 14.1 configuration of seat perimeter edge 14 and riveted, via rivet 82 or otherwise affixed to seat perimeter edge 14 of planar seat 12 to close or contain second open end 26 with planar seat 12. Still furthermore, seat perimeter edge 14 may be configured as groove 14.2 and enable access to the backside of seat perimeter edge 14 wherein sleeve perimeter edge 28 of second open end 26 may be positioned proximate groove 14.2 configuration of seat perimeter edge 14 and riveted or otherwise affixed to seat perimeter edge 14 of planar seat 12 to close or contain second open end 26 with planar seat 12.

Figure 5:
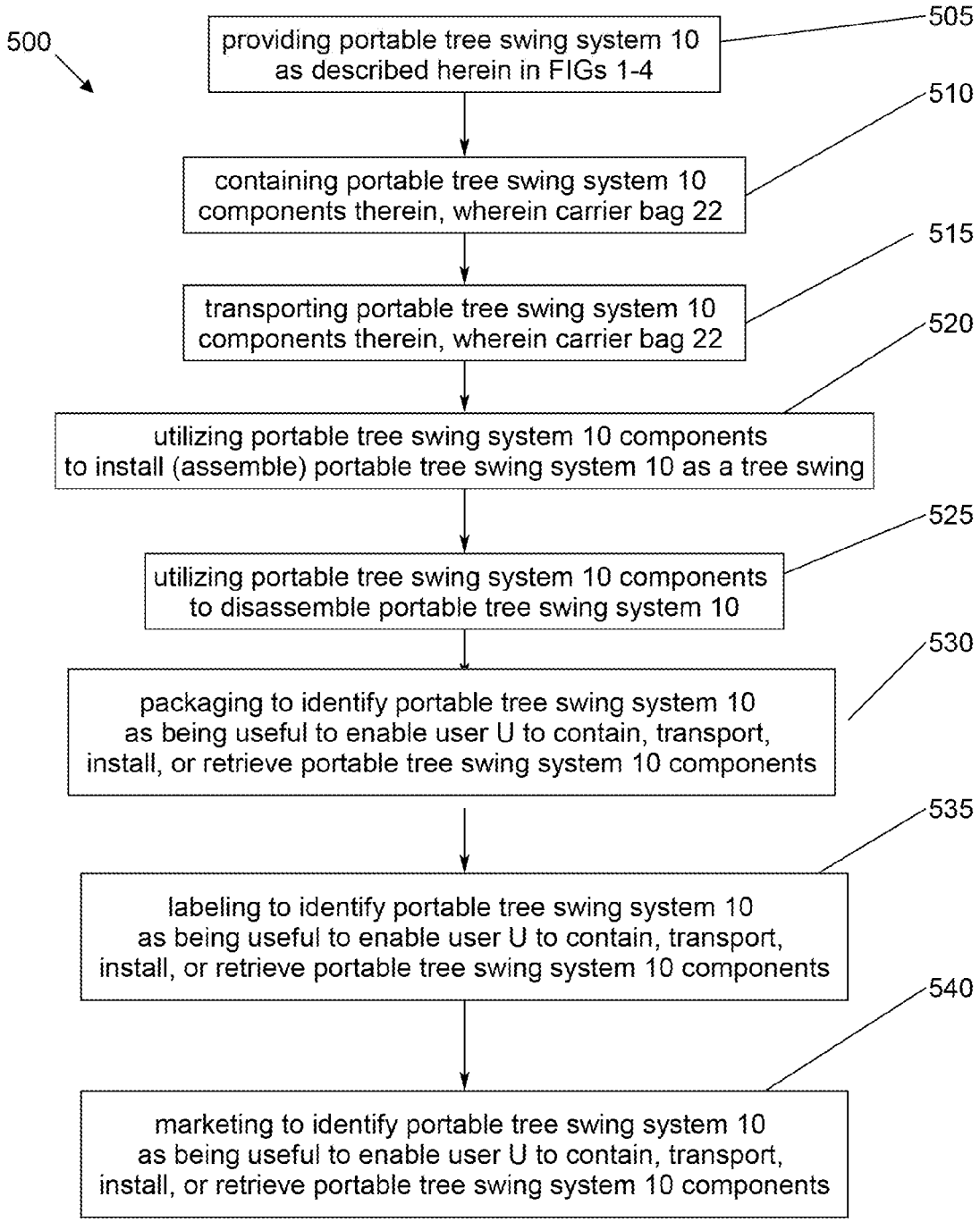
FIG. 5 is a flow diagram of the steps of containing, transporting, installation, use, retrieval, packaging, labeling, and marketing of tree swing apparatus of FIGS. 1-4.

Referring now to FIG. 5, there is illustrated a flow diagram 500 of a method of providing, containing, transporting, installing, retrieving and marketing, portable tree swing system 10 as described herein in FIGS. 1-4. In block or step 505, providing portable tree swing system 10 as described herein in FIGS. 1-4. In block or step 510, containing portable tree swing system 10 components therein, wherein sleeve 22 integrated planar seat 12 may be configured to house or contain all necessary equipment for installation of a tree swing, such as support rope 44, ring 64, retrieval line 54, closeable fastener 58 and other miscellaneous items. In block or step 515, transporting portable tree swing system 10, wherein sleeve 22 integrated planar seat 12 may be configured to transport all necessary equipment for installation of a tree swing, such as support rope 44, ring 64, retrieval line 54, closeable fastener 58 and other miscellaneous items.

In block or step 520, utilizing portable tree swing system 10 components to install (assemble) portable tree swing system 10 as a tree swing, such as support rope 44, ring 64, retrieval line 54, closeable fastener 58 and other miscellaneous items. Closing or sealing closeable mechanism 32 of sleeve 22 to secure excess support rope 44 and retrieval line 54 therein sleeve 22 under planar seat 12 and preferably up off the ground or away from a user of portable tree swing system 10.

In block or step 525 utilizing portable tree swing system 10 components to disassemble portable tree swing system 10.

In block or step 530, packaging to identify portable tree swing system 10 as being useful to enable user U to contain, transport, install, or retrieve portable tree swing system 10 components, such as portable tree swing system 10 as a tree swing, such as support rope 44, ring 64, retrieval line 54, closeable fastener 58 and other miscellaneous items. In block or step 535, labeling to identify portable tree swing system 10 as being useful to enable user U to contain, transport, install, or retrieve portable tree swing system 10 components, such as portable tree swing system 10 as a tree swing, such as support rope 44, ring 64, retrieval line 54, closeable fastener 58 and other miscellaneous items. In block or step 540, marketing to identify portable tree swing system 10 as being useful to enable user U to contain, transport, install, or retrieve portable tree swing system 10 components, such as portable tree swing system 10 as a tree swing, such as support rope 44, ring 64, retrieval line 54, closeable fastener 58 and other miscellaneous items.

The foregoing description and drawings comprise illustrative embodiments of the present invention. Having thus described exemplary embodiments, it should be noted by those ordinarily skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one ordinarily skilled in the art to which this invention pertains having the benefit of the teachings presented in the foregoing descriptions and the associated drawings. Although specific terms may be employed herein, they are used in a generic and descriptive sense only and not for purposes of limitation. Moreover, the present invention has been described in detail; it should be understood that various changes, substitutions and alterations can be made thereto without departing from the spirit and scope of the invention as defined by the appended claims. Accordingly, the present invention is not limited to the specific embodiments illustrated herein, but is limited only by the following claims.

What is claimed is:

1. A portable tree swing apparatus for a tree limb, the apparatus comprising:

a planar seat being rigid, said planar seat having a first hole positioned therein a middle of said planar seat configured for hanging the planar seat from the tree limb, and said planar seat having a bottom surface and a seat perimeter edge;

a bag, said bag having a first open end and a bottom, said bottom is affixed to said bottom surface of said planar seat and has a second hole positioned therein in alignment with said first hole;

a closeable mechanism, said closeable mechanism is integrated with said first open end of said bag to close said first open end;

a support rope having a loop end and a free end for forming a running closed loop around the tree limb, said free end configured to pass through said first hole and said second hole;

a retrieval line having a closeable fastener and a free line end, the retrieval line connected to the loop end of said support rope by the closeable fastener, and said free line end configured to pass through said first hole and said second hole; and a ring;

wherein, when the planar seat is hung from the tree limb with the support rope, said bag hangs from the bottom surface of the planar seat where the closeable mechanism encloses the free line end of the retrieval line and the free end of the support rope including a knot in the free end, any excess support rope, and said ring integrated into said knot; and wherein, when the portable tree swing apparatus is removed from the tree limb, said bag folds over the seat perimeter edge of the planar seat whereby the planar seat is positioned inside the bag on the bottom of the bag, and the closeable mechanism encloses the planar seat, support rope, ring and retrieval line for transportation.

2. The apparatus of claim 1, wherein said seat perimeter edge further comprises a rim.

3. The apparatus of claim 1, wherein said seat perimeter edge further comprises a groove.

4. The apparatus of claim 1, wherein said planar seat being circular.

* * * * *